US008240373B1

(12) United States Patent
Britton et al.

(10) Patent No.: US 8,240,373 B1
(45) Date of Patent: Aug. 14, 2012

(54) APPARATUS AND METHOD FOR REMOVING DEBRIS FROM A WELL

(75) Inventors: Mark S. Britton, Carter, OK (US); Raymond C. Hamilton, Woodward, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

(21) Appl. No.: 13/337,994

(22) Filed: Dec. 27, 2011

(51) Int. Cl.
*E21B 37/00* (2006.01)
*E21B 31/08* (2006.01)

(52) U.S. Cl. ..... 166/99; 166/311

(58) Field of Classification Search ..... 166/298, 166/311, 99, 333.1
See application file for complete search history.

(56) References Cited

U.S. PATENT DOCUMENTS

2005/0072571 A1* 4/2005 Penisson ..... 166/311
* cited by examiner

*Primary Examiner* — Brad Harcourt
(74) *Attorney, Agent, or Firm* — Mary M. Lee

(57) ABSTRACT

An apparatus and method for retrieving debris from the well bore of an oil or gas well. The apparatus comprises a junk basket with a flow passage that allows fluid to be jetted out end of the tool while the tubing string is advanced to stir up the debris in the well fluids and facilitate capture of the debris in the strainer basket. Importantly, upon encountering a plug of sand or other debris in the well bore, fluid flow through the tool can be increased to work on the plug until it breaks apart. Advancement of the tubing string can be halted and resumed, as needed, in combination with control of the fluid flow through the tool until the junk basket is full or the targeted debris is collected, whereupon the junk basket is withdrawn. The junk basket may be deployed on coiled tubing or a string of drill pipe.

8 Claims, 1 Drawing Sheet

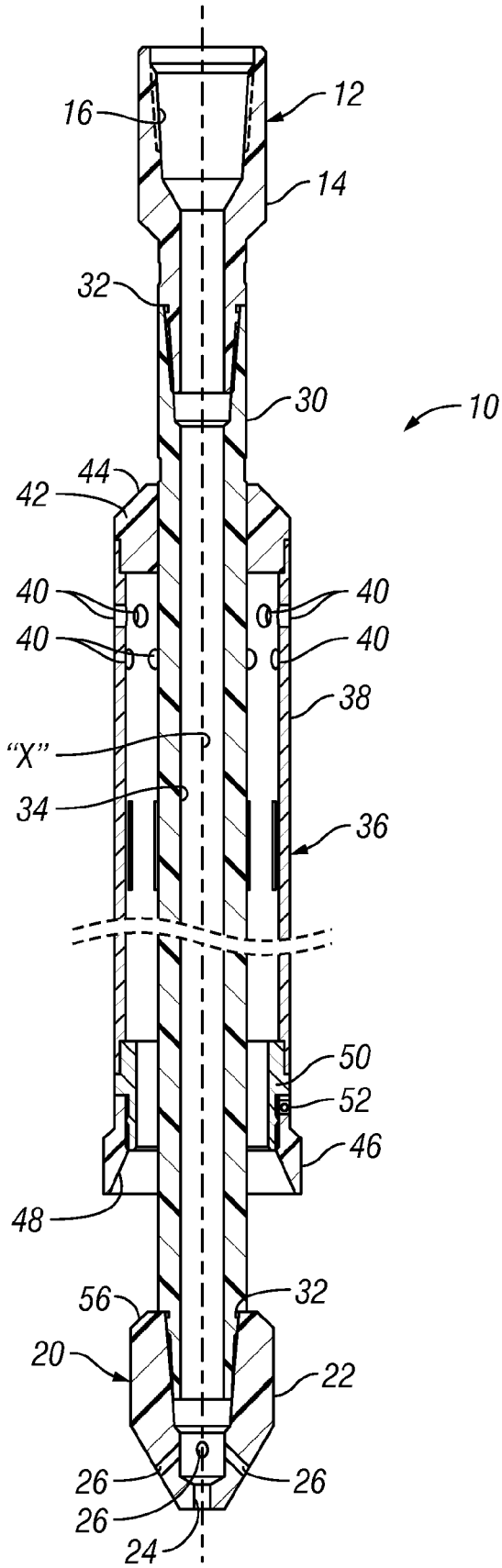
16
12
14
32
30
10
44
42
40
40
40
40
38
"X"
34
36
50
52
46
48
56
32
20
22
26
26
26
24

APPARATUS AND METHOD FOR REMOVING DEBRIS FROM A WELL

FIELD OF THE INVENTION

The present invention relates generally to oil field services and tools and, more particularly but without limitation, to methods and devices for retrieving debris from a well.

BRIEF DESCRIPTION OF THE DRAWING

The accompanying drawing, which is incorporated into and forms a part of the specification, illustrates an embodiment of the present invention and, together with the description, serves to explain the principles of the invention. The drawing merely illustrates a preferred embodiment of the invention and is not to be construed as limiting the invention.

The sole FIGURE is a longitudinal sectional view of a junk basket in accordance with a preferred embodiment of the present invention.

DETAILED DESCRIPTION OF THE PREFERRED EMBODIMENT(S)

Tools referred to as "junk baskets" have long been used in oil and gas wells to remove or retrieve debris. A typical junk basket comprises a strainer basket slidably supported on a central mandrel that is attached to the tubing string. The tubing string may be drill pipe or coiled tubing. As the tubing string is advanced down through the well, the basket is moved upwardly on the mandrel exposing the open end of the basket and allowing debris to collect inside while the well fluids pass through the strainer openings. When the tubing string is withdrawn, the basket moves downwardly on the mandrel to close the end of the basket thereby permitting retrieval of the collected debris.

Occasionally, the end of the junk basket will encounter a mass of sand or other collected debris that has occluded the well bore. This prevents the flow of well fluids and also the further advancement of the tubing string. The debris removal tool of the present invention allows continuous fluid flow through the tool to provide a fluid jet and create fluid turbulence at the end of the tool string to break up and dislodge any such obstructions in the well.

Turning now to the FIGURE, there is shown therein a preferred embodiment of the debris removal tool of the present invention designated generally by the reference number 10. The tool 10 comprises an upper end 12 connectable to the end (not shown) of the tubing string. For that purpose, the end 12 may comprises a tubular coupling member or top sub 14 with a threaded portion, such as the internally threaded portion 16.

The tool 10 further comprises a bottom end 20. The bottom end 20 preferably is adapted to engage a collection of sand or other mass of debris. To that end it may be beveled or conical in shape. The bottom end 20 also should be adapted to provide a stream of fluid therethrough and thus, like the top sub 14, also is tubular. Most preferably, the bottom end 20 takes the form of a nose member 22 with at least one fluid outlet and more preferably with a plurality of outlets sized and positioned to provide multiple jets of fluid at the leading end of the nose 22. For example, the nose 22 may have a first outlet 24 along the longitudinal axis "X" of the tool 10. Additionally, the nose 22 also may have one or more angled outlets or jets, designated in the FIGURE collectively at 26.

Extending between upper end 12 and the lower end 20 of the tool 10 is a tubular member such as the mandrel 30. The nose 22 may be threadedly connected to the downhole end of the mandrel 30, while the uphole end is threadedly connected to the downhole end of the top sub 14. These threaded connections may be provided with seals, such as O-rings 32. Of course, other types of connections may be utilized. Still further, the mandrel 30 may be integrally formed with the top sub 14 or the nose 22 or both. Thus, the lumens of the top sub 14, the mandrel 30, and the nose 22 are continuous and form a flow passage 34 extending end-to-end through the tool 10.

A strainer basket 36 is slidably supported on the mandrel 30 between the top sub 14 and the nose 22. While the structure and shape of the strainer basket 36 may vary, in a preferred form the strainer basket comprises a tubular body 38 with multiple strainer openings 40, which may be located near the uphole end of the body.

The uphole end of the body 38 may be provided with an upper end member 42 that fits on the mandrel 30. The upper end member 42 preferably has a sloped exterior wall 44 on its uphole end.

The downhole end of the body 38 is open. In this particular embodiment, the downhole end of the body comprises a gage ring 46 with a flared inlet 48. The gage ring 46 may be connected to the end of the body 38 by a threaded coupler 50. A set screw 52 may be employed to secure the gage ring 46 to the coupler 50. The upper end of the nose 22 preferably has an angled annular shoulder 56 to facilitate a sealing engagement with the flared inlet 48 of the basket 36.

Now it will be understood that that, as the tubing string (not shown) is advanced into the well bore, the strainer basket 36 will be urged upwardly on the mandrel 30 allowing debris carried in the well fluids to enter the flared inlet 48. When the tubing string is withdrawn from the well, the strainer basket 36 will be urged downwardly on the mandrel 30 until the flared inlet 48 abuts the shoulder 56 and closes the basket. This allows the collected debris to be pulled up to the surface.

Having described the preferred structure of the tool 10, the preferred method of using it to retrieve debris from a well now will be explained. First the tool is attached to the end of the tubing string. Then the tubing string is introduced into the well and advanced in a conventional manner. While the tubing string is advanced, fluid may be circulated down through the tubing string through the flow passage 34 in the tool 10 and out the end outlet 24 and angled jets 26. This flow will agitate the well fluids and assist in the flow of fluid through the strainer basket 36. Fluid flow through the tool may be continuous or intermittent.

In the event a mass of sand or other debris or plug is encountered in the well bore, advancement of the tubing string may be halted while the fluid flow is continued, and the tubing string may even be withdrawn slightly. This will allow the fluid jets to work on the obstruction until it is broken and dislodged. If necessary, fluid flow may be increased to facilitate the disintegration of the plug or obstruction. Then, advancement of the tool string may be resumed until the operation is completed.

Now it will be appreciated that the present invention provides an apparatus and method for retrieving debris from the well bore of an oil or gas well. The tool enables continuous fluid flow while the drill sting is advanced to agitate well fluids and debris, enhancing the operation of the tool and reducing the likelihood that operation will be interrupted by blockages of sand and debris in the well As used herein, phrases such as forwards, backwards, above, below, higher, lower, uphole, and downhole are relative to the direction of advancement of the tool string in the well and are not limited to precisely vertical or horizontal directions.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A junk basket tool for use with a tubing string for retrieving debris from an oil or gas well, the junk basket tool comprising:

a tubular mandrel having an upper end and a lower end, the upper end being connectable to the tubing string;

a nose on the lower end of the mandrel, the nose having at least one fluid outlet;

wherein the mandrel and the nose form a continuous fluid flow passage therethrough; and a tubular strainer basket slidably supported for axial movement on the mandrel between an open position and a closed position, the strainer basket having a closed upper end and an open lower end and forming a debris collection chamber therebetween with fluid ports;

wherein the strainer basket, the mandrel, and the nose are relatively configured so that in the open position debris-carrying well fluids can enter the open lower end of the strainer basket and fluid can exit the debris collection chamber through the fluid ports allowing the debris to collect in the debris collection chamber and so that in the closed position the open lower end of the strainer basket is occluded by the nose, whereby the strained debris can be withdrawn from the well bore; and wherein the fluid flow passage is configured to allow fluid to be passed through from the tubing string through the mandrel and out the at least one fluid outlet of the nose while the tubing string is advanced.

2. The junk basket tool of claim 1 further comprising a top sub on the upper end of the mandrel for attaching the mandrel to the tubing string.

3. The junk basket tool of claim 1 wherein the at least one fluid outlet in the nose comprises an end outlet aligned with the longitudinal axis of the tool.

4. The junk basket tool of claim 3 wherein the at least one fluid outlet in the nose further comprises a plurality of angled outlets spaced circumferentially around the end of end outlet.

5. The junk basket tool of claim 1 wherein the open end of the strainer basket comprises a flared inlet.

6. A method for removing debris from the well bore of an oil or gas well, the method comprising:

introducing a junk basket tool into the well bore on a tubing string;

wherein the junk basket comprises a strainer basket slidably supported on a mandrel connected to the tubing string, the strainer basket movable between an open position and a closed position in response to movement of the tubing string so that as the tubing string is advanced the basket is in the open position to collect debris and so that as the tubing string is withdrawn the basket is in the closed position to retain the collected debris;

advancing the tubing string into the well bore; and flowing fluid through the junk basket tool while the tubing string is advanced.

7. The method of claim 6 further comprising:

upon encountering an obstruction in the well bore, halting the advancement of the tubing string and continuing to flow fluid through the junk basket tool.

8. The method of claim 7 further comprising:

increasing the flow of fluid through the tubing string until the obstruction is resolved.

* * * * *